United States Patent [19]

Washizu et al.

[11] Patent Number: 4,956,254

[45] Date of Patent: Sep. 11, 1990

[54] IMAGE FORMING MATERIAL AND METHOD

[75] Inventors: Shintaro Washizu; Jun Yamaguichi, both of Shizuoka, Japan

[73] Assignee: Fuji Photo Film Co., Ltd., Kanagawa, Japan

[21] Appl. No.: 318,301

[22] Filed: Mar. 3, 1989

[30] Foreign Application Priority Data

Mar. 3, 1988 [JP] Japan ..... 63-50292

[51] Int. Cl.[5] ..... G03C 1/727

[52] U.S. Cl. ..... 430/138; 430/337; 430/339

[58] Field of Search ..... 430/138, 337, 339

[56] References Cited

U.S. PATENT DOCUMENTS 4,450,227 5/1984 Holmes et al. ..... 430/339

4,772,541 9/1988 Gottschalk ..... 430/339

*Primary Examiner*—Paul R. Michl

*Assistant Examiner*—Hoa Van Le

*Attorney, Agent, or Firm*—Sughrue, Mion, Zinn, Macpeak & Seas

[57] ABSTRACT

A image forming material is described, comprising a support having thereon a microcapsule-containing layer, said layer including at least one of organic boron compound anion salt of an organic cationic dye represented by formula (I) as described herein, and at least one compound capable of cleaving at least one carbon-boron bond, both components being isolated from each other by the walls of the microcapsules.

Also described is an image forming method which comprises imagewise exposing the aforesaid image forming material to form an image and then contacting the components isolated by the walls of the microcapsules with each other.

7 Claims, No Drawings

IMAGE FORMING MATERIAL AND METHOD

FIELD OF THE INVENTION

This invention relates to a novel image forming material and an image forming method using the material. In particular, the invention relates to a fixable image forming system using a dye bleaching-type image forming material.

More specifically, the invention relates to an image forming material capable of being used for proof papers, printout papers, overlay films, and other hard copy materials, and to a fixable image forming system using the aforesaid material.

BACKGROUND OF THE INVENTION

Various kinds of image forming materials having various structures and compositions and various image forming methods using these materials have been known. Typically, these include silver halide light-sensitive systems (black and white photography, color photography, dry silver light-sensitive thermography, instant photography, etc.), photopolymer systems (printing plates, photoresist, etc.), diazonium coloring systems, free radial photographic systems, etc. Each system has established each independent application field by the various features thereof based on the specific structure and composition of the image forming materials being used.

Another image forming system comprises an image forming system using a cation dye/boron compound anion salt. For example, a light-sensitive pressure-sensitive type image forming system has been disclosed wherein a cation dye/boron compound anion salt is used as a photopolymerization initiator and the salt is encapsulated in microcapsules together with a polymeric monomer and a basic dye precursor, in JP-A-No. 62-143044 and JP-A-No. 62-150242 (the term "JP-A" as used herein means an "unexamined published Japanese patent application").

In the system, images are formed by utilizing the characteristic of the microcapsules that (1) they are hardened (become non-collapsing) by the action of light or (2) undergo a coloring reaction (the coloring reaction occurring by the contact of the basic dye precursor and an acid developer) by collapse upon application of pressure to the microcapsules at unexposed portions.

Also, an image forming system using a cation dye/boron compound anion salt belonging to a dye-bleach-out type is disclosed, for example, in U.S. Pat. Nos. 4,307,182, 4,343,891, 4,450,227, and 4,447,521. The system is a so-called positive type image forming system wherein a cation dye/boron compound anion salt is dissolved in an organic solvent together with a polymer binder and coated on a support, and a bleaching action occurring upon light exposure corresponding to the absorption wavelength of the cation dye is utilized for the image formation.

However, in the aforesaid dye-bleach-out type image forming system, since the image forming material being used in the system is susceptible to light, when the image forming material is exposed to ordinary room light, sun light, or white light even after forming images by light exposure, dye bleaching occurs, and hence handling of such an image forming material is not easy.

For stably preserving the images after formation, the occurrence of dye bleaching at the portions which were not exposed at the image exposure must avoid. For example, it is known to apply a compound capable of cleaving one or more carbon-boron bonds (i.e., fixing agent) onto a material having images formed by impregnation, spraying, coating, vapor exposure, etc., as disclosed, e.g., in U.S. Pat. No. 4,343,891 described above and the images can be stably preserved. This is advantageous for the preservation or fixing of images, but since the aforesaid process is a wet process, the operation is complicated and hence such a process is unpreferably.

On the other hand, for preparing the aforesaid dye-bleach-out bleaching type image forming material composed of a cationic dye/boron compound anion salt, the aforesaid components are usually uniformly dissolved in an organic solvent, coated on a support such as a paper or a plastic film, and the solvent is distilled off by drying. An impregnation or flow stretching may be employed in place of coating. Thus, with the use of such a volatile organic solvent, means for preventing explosions are required for the production equipment, and the aforesaid process is disadvantageous from the viewpoints of safety and cost.

Furthermore, in the case of preparing multicolor image forming materials, multilayer coating of at least three layers (e.g., A color layer/interlayer/B color layer) is required in addition to a means for preventing color mixing, etc., which require specific equipment. If it is possible to not use such multilayer coating equipment, it is, as a matter of course, preferred.

SUMMARY OF THE INVENTION

An object of this invention is to provide an image forming material having excellent image reproducibility and image storage stability (fixing property) and capable of easily obtaining multicolor images and also to provide an image forming method using the image forming material.

It is also an object of this invention to provide a completely dry and simple recording method in the image forming method and the fixing method.

Another object of this invention is to provide an image forming material and to provide an image forming method capable of reducing or eliminating troublesome production equipment such as multilayer coating equipment, etc., which are disadvantageously required for handling materials in an organic solvent system used for the formation of multicolor images.

It has now been discovered that the aforesaid objects can be attained by the present invention as set forth hereinbelow.

That is, in one aspect this invention is directed to an image forming material comprising a support having thereon a microcapsule-containing layer, aforesaid layer including at least one of organic boron compound anion salt of an organic cationic dye represented by formula (I)

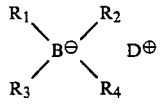

(I)

wherein $D^+$ represents a cationic dye and $R_1$, $R_2$, $R_3$ and $R_4$ each represents a group selected from an alkyl group, an aryl group, an aralkyl group, an alkaryl group, an alkenyl group, an alkinyl group, an alicyclic group, a heterocyclic group, an allyl group, and the derivatives of them, at least two of aforesaid $R_1$, $R_2$, $R_3$ and $R_4$ may combine with each other to form a cyclic structure; and at least one compound capable of cleaving at least one carbon-boron bond, both components being isolated from each other by the walls of the microcapsules.

Another aspect of this invention is directed to an image forming method which comprises imagewise exposing the aforesaid image forming material to form a dye bleached image and then contacting the components isolated by the walls of the microcapsules with each other to perform fixing.

DETAILED DESCRIPTION OF THE INVENTION

An important feature in the image forming material of this invention involves the use of microcapsules. That is, the fundamental functions of microcapsules are as follows.

(1) Plural components can be isolated from each other by existing in the inside and the outside of microcapsules, respectively.

(2) By encapsulating material(s) in microcapsules, the influence of the external circumstance (in particular, the influence of moisture, oxygen, temperature, etc.) on the material(s) is almost completely reduced and the content therein can be stably stored.

(3) If two or kinds of more microcapsules, each kind containing each different kind of component(s) are mixed, the characteristics of each components(s) can be independently kept, i.e., reaction therebetween does not spontaneously occur.

(4) If necessary, the component in the microcapsules can be reacted with the component existing outside the microcapsules by causing the component to escape from the microcapsules or by introducing the outside component into the microcapsules, by applying thereto an external action (e.g., heat, pressure, etc.).

(5) When the core material of microcapsules is an organic solvent such as an oil, the whole microcapsule dispersion can be handled or treated as an aqueous system.

In this invention, the aforesaid functions (1) and (2) are utilized for improving the stability and the image reproducibility of the image forming material, the functions (1) and (4) as a means for a simple recording method such as light exposure and fixing by the application of heating and/or pressure, the function (3) as a means of forming multicolor images, and the functions (3) and (5) for improving the aptitude for production.

In preferred microcapsules for use in this invention, the component(s) in the microcapsules are completely prevented from contacting with the component(s) outside the microcapsules by the material-insulating action of the walls of the microcapsules, and only when the microcapsules are heated (or pressed or heat-pressed) above a certain value, the component(s) in the microcapsules can be brought into contact with the outside component(s).

This phenomenon can be desirably controlled as the change of the properties of the microcapsules walls by properly selecting the material(s) for the walls, the core material(s) of the microcapsules, additives, etc.

Examples of the material for microcapsule walls being used in this invention include polyurethane, polyurea, polyester, polycarbonate, urea-formaldehyde resins, melamine-formaldehyde resins, polystyrene, styrenemethacrylate copolymers, gelatin, polyvinylpyrrolidone, polyvinyl alcohol, etc. These high molecular weight materials may be used singly or as a mixture thereof.

In the aforesaid high molecular weight materials, polyurethane, polyurea, polyamide, polyester, and polycarbonate are preferred, and, polyurethane and polyurea are most preferred in this invention.

It is preferred that the microcapsules for use in this invention are formed by emulsifying a core material containing a reactive material such as an organic boron compound anion salt of an organic cationic dye compound, and then forming a wall of the aforesaid polymer around the oil droplets of the emulsion to encapsulate the core material. In this case, the reactants for forming the high molecular weight material are added to the inside and/or the outside of the oil droplets.

Details of the preferred production processes for microcapsules and of the microcapsules which can be preferably used in this invention are described, e.g., in U.S. Pat. Nos. 3,726,804 and 3,796,696.

For example, in the case of using polyurethane as the wall material for microcapsules, a polyhydric isocyanate and a second material (e.g., polyol) which reacts with the isocyanate to form the wall of the microcapsules are dissolved with an aqueous phase, or mixed with an oily liquid to be encapsulated and dispersed by emulsification in water, and the temperature of the dispersion is increased, whereby a polymer-forming reaction occurs to form the walls of microcapsules. In this case, if polyamine is used as the second material or the second material is not used, polyurea is formed as the wall-forming material. A polyhydric isocyanate can form a polyurea by causing a reaction with water.

The polyhydric isocyanates and the polyols or polyamines being reacted with the isocyanates for use in this case are described, e.g., in U.S. Pat. Nos. 3,281,383, 3,773,695, 3,793,268, 3,723,363 and 3,838,108, JP-B-No. 48-40347 (the term "JP-B" as used herein means an "examined Japanese patent publication"), and JP-A-No. 48-84086.

Examples of the polyhydric isocyanate for use in this invention includes diisocyanates such as m-phenylene diisocyanate, p-phenylene diisocyanate, 2,6-tolylene diisocyanate, 2,4-tolylene diisocyanate, naphthalene 1,4-diisocyanate, diphenylmethane-4,4'-diisocyanate, 3,3'-dimethoxy-4,4'-biphenyl diisocyanate, 3,3'-dimethyldiphenylmethane-4,4'-diisocyanate, xylylene- 1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate; triisocyanate such as 4,4',4''-triphenylmethane triisocyanate, toluene-2,4,6-triisocyanate; tetraisocyanates such as 4,4'-dimethyldiphenylmethane-2,2',5,5'-tetraisocyanate; and isocyanate prepolymers such as the addition product of hexamethylenediisocyanate and trimethylolpropane, the addition product of 2,4-tolylene diisocyanate and trimethylolpropane, the addition product of xylylene diisocyanate and trimethylolpropane, and the addition product of tolylene diisocyanate and hexanetriol.

Examples of the polyol for use in this invention include aliphatic polyhydric alcohols, aromatic polyhydric alcohols, hydroxypolyesters, hydroxypolyalkylene ethers, etc.

Polyols as described in U.S. Pat. No. 4,650,740 can be also used in this invention. Examples thereof include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl- 1,5-pentanediol, 1,4-cyclohexane dimethanol, dihydroxycyclohexane, diethylene glycol, 1,2,6-trihydroxyhexane, 2-phenylpropylene glycol, 1,1,1-trimethylolpropane, hexanetriol, pentaerythriol, pentaerythriol-ethylene oxide addition product, glycerolethylene oxide addition product, condensation products of aromatic polyhydric alcohols and alkylene oxide, such as 1,4-di(2-hydroxyethoxy)benzene or resorcinol dihydroxyethyl ether, p-xylylene glycol, m-xylylene glycol, $\alpha,\alpha'$-dihydroxy-p-diisopropylbenzene, 4,4'-dihydroxydiphenylmethane, 2-(p,p'-dihydroxydiphenylmethyl)-benzyl alcohol, the ethylene oxide addition product of bisphenol A, the propylene oxide addition product of bisphenol A, etc.

It is preferred that the polyol is used in an amount of from 0.02 mol to 2 mols as hydroxy group to 1 mol of the isocyanate.

Examples of the polyamine for use in this invention include ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, an amine addition product of epoxy compound, etc.

It is preferred that the polyamine is used in an amount of from 0.02 mol to 2 mols as hydroxy group to 1 mol of the isocianate.

In this case, an organic solvent for forming oil drops can be property selected from high-boiling oils and examples thereof include phosphoric acid esters, phthalic acid esters, acrylic acid esters, methacrylic acid esters, carboxylic acid esters, fatty acid amides, alkylated biphenyl, alkylated terphenyl, chlorinated paraffin, alkylated naphthalene, diarylethane, etc. Specific examples thereof are described in JP-A-No. 60-242094 and JP-A-No. 63-45084.

In this invention, an auxiliary solvent can be added to the aforesaid organic solvent as a dissolution aid. Examples of such an auxiliary solvent are methyl isobutyl ketone, diisobutyl ketone as well as low-boiling solvents such as ethyl acetate, isopropyl acetate, butyl acetate, and methylene chloride as particularly preferred ones.

On the other hand, the water-soluble high molecular weight material which exists as a protective colloid in the aqueous phase being mixed with the oily phase can be properly selected from known anionic high molecular weight materials, nonionic high molecular weight materials and amphoteric high molecular weight materials, and among them polyvinyl alcohol, gelatin cellulose derivatives, etc. are preferred.

Also, as the surface active agent being added to the aqueous phase, an anionic or nonionic surface active agent which does not cause precipitation or aggregation by reacting with the aforesaid protective colloid is properly used. Examples of the preferred surface active agent are sodium alkylbenzenesulfonates (e.g.,sodium lauryl sulfonate), sulfosuccinic acid dioctyl sodium salt, polyalkylene glycols (e.g., polyoxyethylene nonylphenyl ether), etc.

In this invention, the size of the microcapsules is preferably not larger than 20 μm, and more preferably not larger than 4 μm as the volume mean particle size by the measurement method described, e.g., in U.S. Pat. No. 4,598,035 from the points of improving the resolving power of images formed, the storage stability of the images, and handling properties of the microcapsules.

If the microcapsules are too small, there is a possibility that the microcapsules enters pores or fibers of the base material. Thus, the lower limit thereof depends upon the nature of the base material or support, but is preferably 0.1 μm. If the microcapsules are larger than 20 μm, the microcapsules tend to collapse, and therefore the handling characteristic tend to be deteriorated.

The components constituting the image forming materials of this invention are explained in further detail below.

The organic boron compound anion salt of an organic cationic dye shown by aforesaid formula (I) can be prepared by uniformly mixing an organic cationic dye and an organic boron compound anion in an organic solvent as such, or by referring to the method described in European Pat. No. 223,587A1.

Examples of the organic cation dye for use in this invention include cationic methine dyes, polymethine dyes (preferably cyanine dye, hemicyanine dye, styryl dye and azomethine dye, more preferably a dye having at least one indolenine structure or benzselenazole structure), carbonium dyes (preferably triarylmethane dye), pyrylium compounds (preferably pyrylium dye, thiapyrylium dye), quinoneimine dyes (preferably azine dye, thiazine dye, oxazine dye), xanthene dyes (preferably rhodamine dye), acridine dyes, azulenium dyes, etc. They can be used singly or as a combination thereof.

In this invention, as the organic cation dye, commercially available products or organic cationic dyes known in the art can be used. Examples of these dyes are described, e.g., in *Senryo Binran* (*Dye Handbook*), "Basic Dye", edited by Yuuki Kagaku Kyokai (July 20, 1970); T. H. James, *The Theory of the Photographic Process*, Macmillan Publishing Co., Ltd , pages 194 to 290, (1977); *Kinoosei Shikiso no Kagaku* (*Chemistry of Functional Dyes*), pages 1 to 32, 189 to 206, and 401 to 413, published by CMC Co., (Jan. 29, 1981); JP-A-No. 59-189340; and European Pat. No. 223587A1.

In the aforesaid dyes, cyanine dyes and xanthene dyes are particularly useful in this invention Typical examples of the useful cyanine dye in this invention are the dyes represented by formula (III)

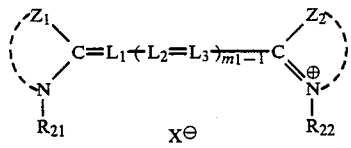

(III)

wherein $Z_1$ and $Z_2$ represents an atomic group necessary for completing a heterocyclic nucleus typically used for cyanine dyes, such as, in particular, a thiazole nucleus, thiazoline nucleus, benzothiazole nucleus, naphthothiazole nucleus, oxazole nucleus, oxazoline nucleus, benzoxazole nucleus, naphthoxazole nucleus, tetrazole nucleus, pyridine nucleus, quinoline nucleus, imidazoline nucleus, imidazole nucleus, benzimidazole nucleus, naphthoimidazole nucleus, selenazoline nucleus, selenazole nucleus, benzoselenazole nucleus, naphthoselenazole nucleus, and indolenine nucleus. These nuclei each may be substituted by a lower alkyl group having from 1 to 4 carbon atom (e.g., methyl), a halogen atom, a phenyl group, a hydroxyl group, an alkoxy group having from 1 to 4 carbon atoms, a carboxyl group, an alkoxycarbonyl group having from 1 to 4 carbon atoms, an alkylsulfamoyl group having from 1 to 4 carbon atoms, an alkylcarbamoyl group having from 1 to 4 carbon atoms, an acetyl group, an acetoxy group, a cyano group, a trichloromethyl group, a trifluoromethyl group, or a nitro group.

$L_1$, $L_2$, and $L_3$ each represents a methine group or a substituted methine group. As the substituent for the substituted methine group, there are a lower alkyl group having from 1 to 4 carbon atoms (e.g., methyl, ethyl), a phenyl group, a substituted phenyl group, a methoxy group, an ethoxy group, an aralkyl group having from 1 to 4 carbon atoms (e.g., phenethyl group), etc.

$L_1$ and $R_{21}$, $L_3$ and $R_{22}$, and $L_2$ and $L_2$ when $m_1$ is 3 may be alkylene-linked or may form a 5- or 6-membered ring.

In formula (III), $R_{21}$ and $R_{22}$ represents a lower alkyl group (preferably an alkyl group having from 1 to 8 carbon atoms); an alkyl group substituted by a carboxy group, a sulfo group, a hydroxy group, a halogen atom, an alkoxy group having from 1 to 4 carbon atoms, a phenyl group, a substituted phenyl group, etc., [the alkylene moiety having preferably from 1 to 5 carbon atoms, examples of the substituted alkyl group are β-sulfoethyl, γ-sulfopropyl, γ-sulfobutyl, δ-sulfobutyl, 2-[2-(3-sulfopropoxy)ethoxy]ethyl, 2-hydroxysulfopropyl, 2-chlorosulfopropyl, 2-methoxyethyl, 2-hydroxyethyl, carboxymethyl, 2-carboxyethyl, 2,2,3,3-tetrafluoropropyl, and 3,3,3-trifluoroethyl]; an allyl group; or other substituted alkyl group which is usually used for N-substituent for cyanine dyes. Also, $m_1$ represents 1, 2, or 3; and $X_1\ominus$ represents the boron compound anion of the aforesaid structure of formula (I).

Specific examples of the xanthene dyes which are preferably used for this invention include dyes as represented by formula (IV) wherein $R_{31}$, $R_{32}$, $R_{33}$, and $R_{34}$ each independently represents a hydrogen atom, an alkyl group having from 1 to 6 carbon atoms, or an aryl group; $X\ominus$ represents the boron compound anion of aforesaid structure of formula

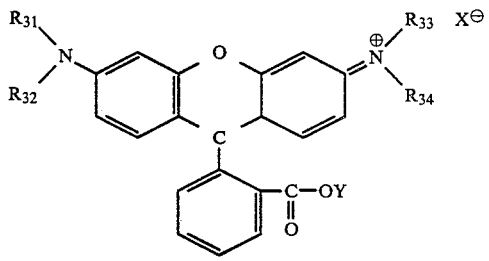

(IV)

(I): and Y represents a hydrogen atom, an alkyl group, an aryl group, or an alkali metal.

Specific examples of the organic boron compound anion salt of the organic cationic dye compound which are preferably used in this invention are illustrated below, but the invention is not limited to them.

1.

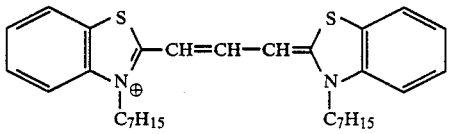

2.

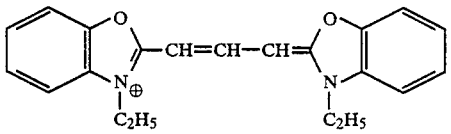

3.

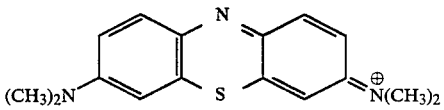

4.

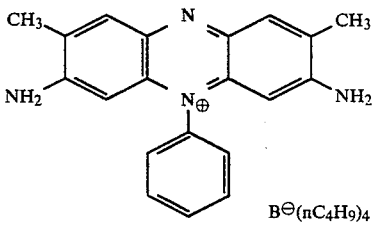

-continued
5.
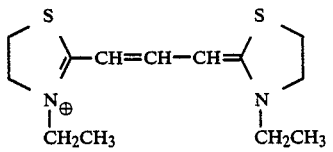
$B^{\ominus}(nC_4H_9)_4$
6.
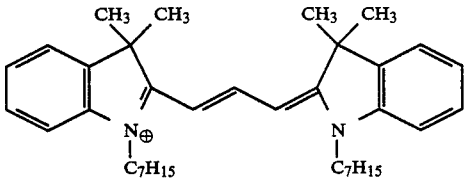
$B^{\ominus}(nC_4H_9)_4$
7.
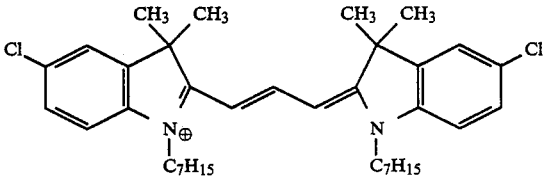
$B^{\ominus}(nC_4H_9)_4$
8.
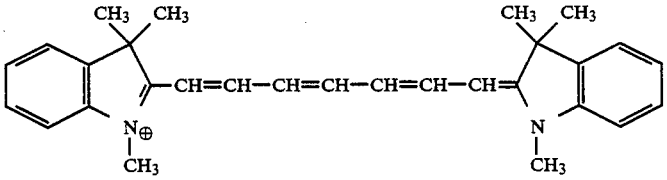
$B^{\ominus}(nC_4H_9)_4$
9.
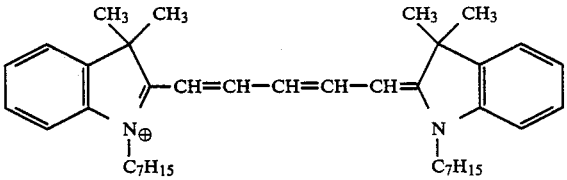
$B^{\ominus}(nC_4H_9)_4$
10.
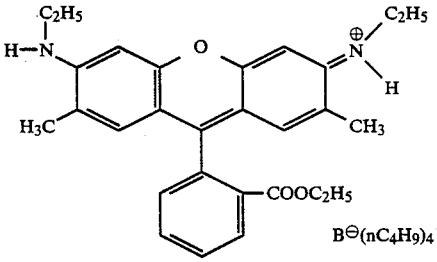
$B^{\ominus}(nC_4H_9)_4$
11.
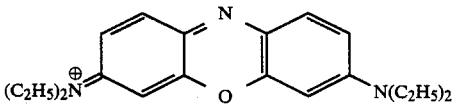
$B^{\ominus}(nC_4H_9)_4$ -continued
12.
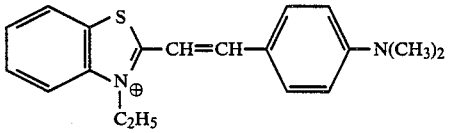
$B^{\ominus}(nC_4H_9)_4$
13.
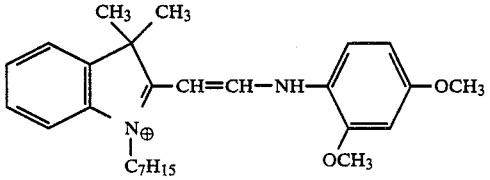
$B^{\ominus}(nC_4H_9)_4$
14.
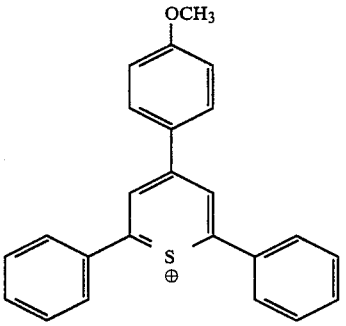
$B^{\ominus}(nC_4H_9)_4$
15.
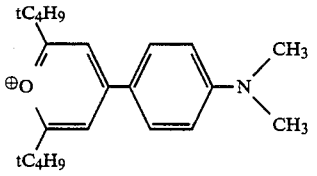
$B^{\ominus}(nC_4H_9)_4$
16.
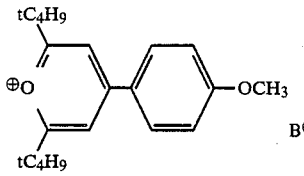
$B^{\ominus}(nC_4H_9)_4$
17.
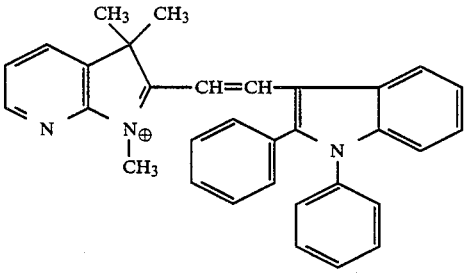
$B^{\ominus}(nC_4H_9)_4$ -continued

18.

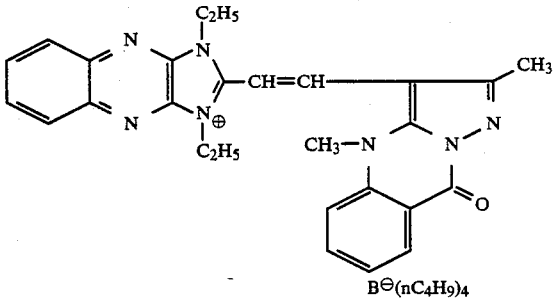

19.

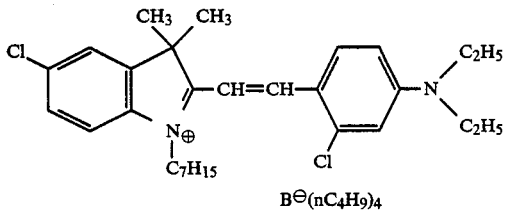

20.

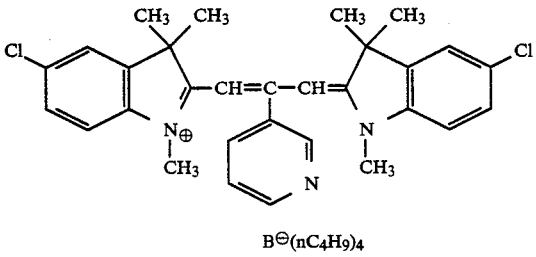

21.

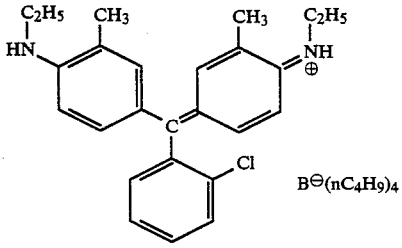

In addition, in the above-illustrated compounds, the organic boron compound anion is shown as $B^{\ominus}(nC_4H_9)_4$ but other organic boron compound anions such as those illustrated below can be also used.

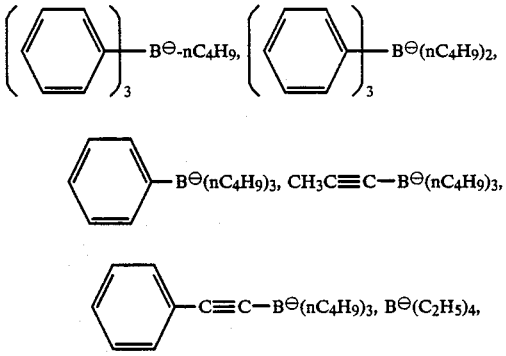

-continued

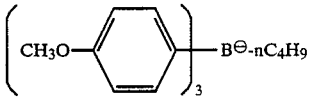

Also, for efficiently performing the light bleaching action of dye, it is preferred that the organic boron compound anion exist in the system in same molar ratio as or slightly excessive with respect to the organic cationic dye, and the organic boron compound anion particularly preferably exists in the range from 1/1 to ½ in mol ratio.

In the aforesaid organic boron compound anion salt of organic cationic dye, the organic cationic dye spectrally sensitizes the organic boron compound anion by absorbing light of the corresponding wavelength to attain light bleaching. Accordingly, in the case of preparing a multicolor image forming system, the system may be constructured in the same manner as the combination of a spectral sensitizing dye and a silver salt in an ordinary silver salt color photographic system. That is, organic cationic dyes each absorbing an appropriate spectral wavelength are properly selected, each dye is combined with an organic boron compound to form a salt thereof, and each salt is encapsulated by each microcapsules. The microcapsules each for each color thus obtained are mixed and coated on a support, if necessary, using a proper binder, to provide a multicolor light-sensitive material. Thus, in the image forming system of this invention, microcapsules of each color having different spectral wavelength can exist as each picture element in the light-sensitive layer and multicolor images can be easily formed.

In the image forming system of this invention, stable images can be obtained by applying, such as heat treatment after forming images by imagewise exposure. That is, in the fixing mechanism of the image forming system of this invention, the organic boron compound anion salt of an organic cationic dye existing in the microcapsules is brought into contact with a fixing agent existing outside the microcapsules by heating, whereby the further occurrence of light bleaching of the dye is inhibitied by the action of the fixing agent even when the light-sensitive layer is exposed to light.

The fixing agent for use in this invention is defined to be a compound capable of cleaving at least one carbon-boron bond of the organic boron compound and includes the following compounds. That is, there are organic carboxylic acids (e.g., acetic acid, stearic acid, salicyclic acid and the derivatives of these acids), inorganic acids (e.g., nitric acid, sulfuric acid, hydrobromic acid, hydrochloric acid, hydrofluoric acid, sulfamic acid, and the salts of these acids), other organic acids than organic carboxylic acids (e.g., sulfonic acid, sulfinic acid, fluorocarboxylic acid, per-fluorocarboxylic acid, and the derivatives thereof), phenols, quinones, bisimidazole compounds, peroxides, and a compound containing a metal ion which is more reducible than ferric ion (e.g., a compound containing $Ag^{+}$, $Pd^{++}$, $Fe^{+++}$, etc.).

Then, specific examples of fixing agents preferably used in this invention are illustrated below, but the invention is not limited to them.

1.

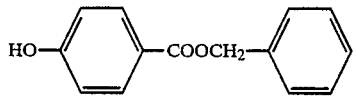

2.

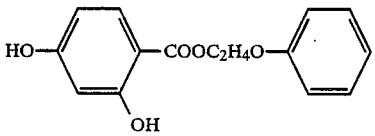

3.

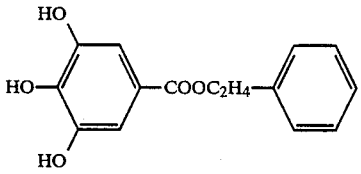

4.

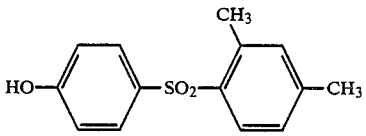

-continued

5.

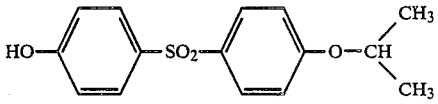

6.

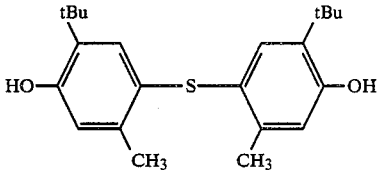

7.

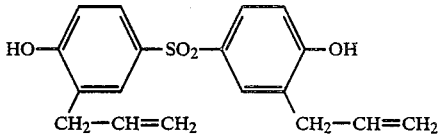

8.

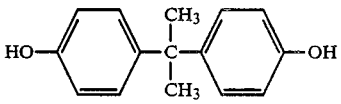

9.

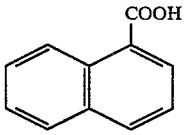

10.

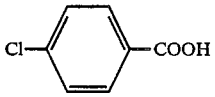

11.

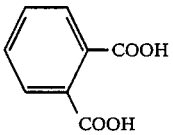

12.

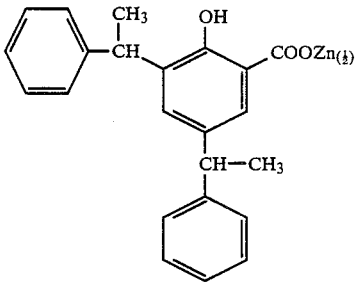

13.

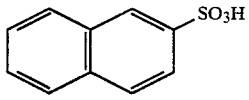

14.

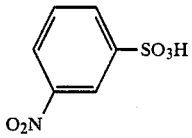

-continued

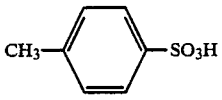

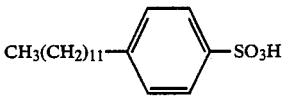

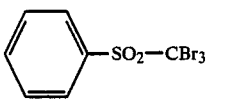

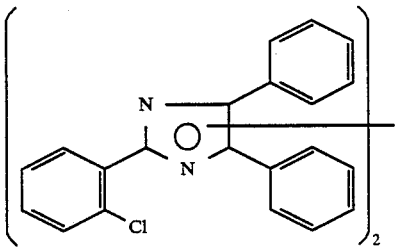

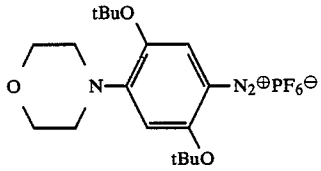

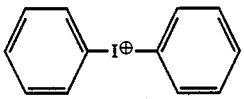

$PF_6^{\ominus}$

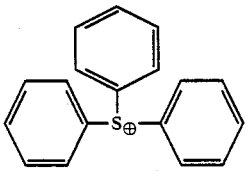

$AsF_6^{\ominus}$

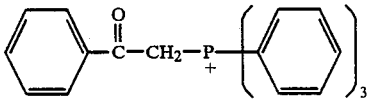

$SbF_6^{-}$

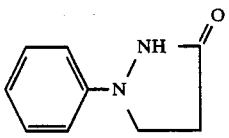

$NH_2NH_2.H_2SO_4$

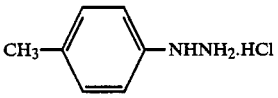

-continued

15.

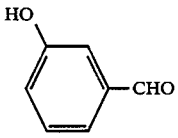

26.

16.

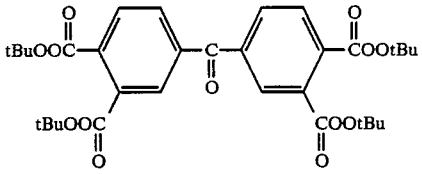

27.

17.

18. The aforesaid compounds functioning as fixing agents can be used singly or as a combination thereof.

In the image forming material of this invention, the aforesaid organic boron compound anion salt of organic cationic dye and/or the aforesaid fixing agent exists in microcapsules. However, when two of them exist in a microcapsule, they cannot be included in one microcapsule simultaneously. In the case that two of the substances exist in a microcapsules, they are included in separate microcapsules, respectively.

19. When the fixing agent does not exist in microcapsules, it is preferred that the fixing agent is dispersed as solid by a sand mill, etc., or is dispersed by emulsification as a solution in an oil.

20. In the case of dispersing the fixing agent as a solid, the fixing agent is dispersed in a solution of a water-soluble polymer having a concentration of from 2 to 30% by weight and the preferred size of the dispersed particles thereof is not larger than 10 μm. As the preferred water-soluble high molecular weight material which is used in this case, there are water-soluble high molecular weight materials which are used for making microcapsules.

21. For dispersing the fixing agent by emulsification, the method and materials described in JP-A-63-45084 can be referred to.

22. The amount of the fixing agent is preferably from 1 to 100 molar times the amount of the organic boron compound anion, and for obtaining the desired result the fixing agent is generally used in an amount as small as possible; thus, the amount thereof is more preferably in the range of from 1 to 10 molar times.

23. In addition, fixing of images in this invention can be effectively achieved by bringing the organic boron compound anion salt of organic cationic dye into the fixing agent through the wall of microcapsules by heating; however, the same effect for fixing can be also obtained by collapsing the microcapsules by pressure in this invention. Also, simultaneously applying heating and pressing, the additive effect thereof can be utilized.

24. Examples of the heating method include a method of passing the light-sensitive material through high-temperature rollers, a method of irradiating the light-sensitive material by infrared rays, a method of treating with a microwave range, a method of treating with ultrasonic wave, a method of exposing the light-sensitive material to a high-temperature vapor, etc.

25. Also, fixing can be as a matter of course practiced by treating the light-sensitive material with a solvent such as ethyl acetate, acetone, etc.

Furthermore, in the case of obtaining monochromatic images using the image forming material of this invention, the fixing agent only is encapsulated in the microcapsules for imparting a fixing property in the system.

In such case, the organic boron compound anion salt of organic cationic dye can exist in a water phase binder in the form of a solid dispersion or an emulsion.

The image forming material of this invention can be prepared by applying the dispersion of the fixing agent and microcapsules containing the organic boron compound anion salt of organic cationic dye to a support by coating or impregnation, or the image forming material may be prepared by forming a self-supporting layer of the aforesaid dispersion.

In this case, a binder can be added to the aforesaid dispersion and as the binder, there are various kinds of emulsions of polyvinyl alcohol, methyl cellulose, carboxymethyl cellulose, hydroxypropyl cellulose, gum arabic, gelatin, polyvinylpyrrolidone, casein, a styrenebutadiene latex, an acrylonitrilebutadiene latex, polyvinyl acetate, a polyacrylic acid ester, an ethylenevinyl acetate copolymer, etc. The amount of the binder is generally from 0.5 $g/m^2$ to 5 $g/m^2$ as solid component.

The coating amount for the image forming material is preferably from 3 $g/m^2$ to 30 $g/m^2$, and more preferably from 5 $g/m^2$ to 20 $g/m^2$ as solid components. If the coating amount is less than 3 $g/m^2$, a sufficient density is not obtained, while if the amount is more than 30 $g/m^2$, further improvement of the quality is not obtained, and hence the use of such a large amount is disadvantageous in cost.

The materials for the support of the image forming material of this invention include materials generally used in graphic art or decoration, e.g., papers such as tissue paper, paper board, etc.; films of plastics or polymers such as ergenerated cellulose, cellulose acetate, cellulose nitrate, polyethyleneterephthalate, vinylic polymers and copolymers, polyethylene, polyvinyl acetate, polymethyl methacrylate, polyvinyl chloride, etc.; fabrics; glass plates, woods, metal sheets or foils, etc.

For coating the aforesaid dispersion on a support, a coating method well known generally, such as a dip coating method, an air knife coating method, a curtain coating method, a roller coating method, a doctor coating method, a wire bar coating method, a slide coating method, a gravure coating method, a spin coating method, and an extrusion coating method employing a hopper described in U.S. Pat. No. 2,681,294 can be used.

In this invention, any convenient light source can be used for forming the light bleached images of the organic boron compound anion salt of organic cationic dye. That is, the light for the light irradiation may be natural or artificial, monochromatic or polychromatic, non-coherent or coherent light, and, for the proper activation of the image forming composition, the light must have a sufficient density.

A conventional light for use in this invention includes a fluorescent lamp, a mercury lamp, a metal arc lamp, and an arc lamp. Coherent light source includes a nitrogen laser, xenon laser, argon ion laser, semiconductor laser, and ionized neon laser, the wavelength of the emitted light of which is in the range of the ultraviolet or visible light absorption band of the image forming composition or overlaps the range. Also, a ultraviolet or visible light emitting cathode ray tube, which is widely used in a printout system for writing on light-sensitive materials, is useful for the image forming material of this invention.

In the image forming method of this invention, images can be formed by writing with a light beam or by light exposing the light-sensitive material through a positive film, a negative film, or a stencil having images, or through relatively opaque patterns.

The images of a positive or negative film may be silver images or opaque images formed by the aggregation of the regions having a different refractive index from other portions on a cellulose acetate film or a polyester film.

The formation of images on the image forming material of this invention may be performed by a conventional diazo printing apparatus, a graphic art exposure, an electron flash apparatus, or the projection described in U.S. Pat. No. 3,661,461.

The exposure time may be changed in the range of from about 1/10 second to several minutes according to the density and spectral energy distribution of light, the distance of light from the light-sensitive material, the nature and amount of the image forming composition, and the color density of desired images.

After imagewise exposure, the images formed can be fixed by bringing the organic boron compound anion salt of organic cationic dye into contact with the fixing agent.

For contacting both components with each other, various methods can be applied.

For example, there is a heating method. In the method, the temperature of the microcapsule walls is increased above the glass transition point of the material of the microcapsules, whereby the components existing in the inside of and outside the microcapsules pass through the softened microcapsule walls and are brought into contact with each other. The glass transition point of the microcapsule wall differs according to the material being used for the wall, and hence the heat treatment condition necessary for fixing can be properly selected by considering the material.

In another method, both of the components can be brought into contact with each other by collapsing microcapsules by mechanical force. In the method, a material having a high glass transition point can be used for the microcapsule wall. The force necessary for collapsing depends upon the nature of materials being used and the particle size of the microcapsules but can be easily selected by a person skilled in the art.

The image forming method of this invention is excellent in productivity, image reproducibility, and image storage stability (fixing property), can easily form multicolor images, and is a simple recording method.

The following examples are intended to illustrate the present invention but not to limit it in any way. In addition, all parts in these examples are by weight.

EXAMPLE 1

Image forming materials (Samples) shown below were prepared.

Sample (1)

The following components were mixed with each other.

| | |
|---|---|
| Organic boron compound anion salt of organic cationic dyes having the following structure | 0.41 part |

-continued

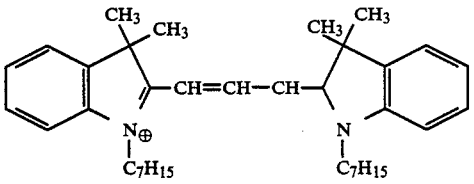

$B^{\ominus}(nC_4H_9)_4$

| | |
|---|---|
| (Dye No. 6: Magenta dye) | |
| Methyl isobutyl ketone | 12 parts |
| Tricresyl phosphate | 15 parts |
| Takenate D-110N (trademark of 75% by weight ethyl acetate solution made by Takeda Chemical Industries, Ltd.) | 12 parts |

The mixture thus obtained was dispersed by emulsification in an aqueous solution composed of 65 parts of an aqueous solution of 8% by weight polyvinyl alcohol, 15 parts of an aqueous solution of 1.67% by weight diethylenetriamine, and 30 parts of distilled water at 20° C. to provide an emulsion having a mean particle size of 1 μm. Furthermore, the emulsion obtained was stirred for 3 hours at 40° C. Thereafter, the mixture was allowed to cool to room temperature followed by filtration to provide an aqueous dispersion of microcapsules composed of polyurea.

The following components were mixed.

| | |
|---|---|
| Aqueous solution of 4% by weight polyvinyl alcohol | 150 parts |
| Fixing agent having the following structure (Fixing agent No. 1) | 30 parts |

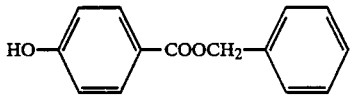

The mixture of dispersed by Dynomill (trade name, made by Willy A Bachofen A.G.) to provide a dispersion of the solid fixing agent having a mean particle size of 3 μm.

9 parts of the aforesaid microcapsule dispersion was mixed with 9 parts of the fixing agent dispersion, and the mixture was coated on art paper by a coating rod 18 followed by drying for one minute at 50° C. to provide Sample (1).

Sample (2)

By following the same procedure as the case of preparing Sample (1) except that 0.08 part of $N(CH_3)_4^{\oplus}B^{\ominus}nC_4H_9)_4$ was further added to the composition being encapsulated (i.e., the content of the organic boron compound anion was slightly increased) to provide Sample (2).

Sample (3)

By following the same procedure as in the case of preparing Sample (1) except that the following materials were uniformly dissolved in methyl isobutyl ketone as the organic cationic dye compound and the organic boron compound, respectively, Sample (3) was prepared.

| | |
|---|---|
| Organic cationic dye compound | 0.33 part |

-continued

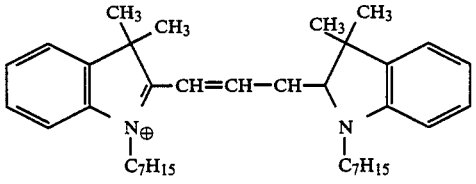

$I^{\ominus}$

| | |
|---|---|
| Organic boron compound $N(CH_3)_4^{\oplus\ominus}B(nC_4H_9)_4$ | 0.16 part |

Sample (4)

By following the same procedure as in the case of preparing Sample (3), except that the amount of the organic boron compound in Sample (3) was changed to 0.24 part, Sample (4) was prepared.

Each of the Samples (1) to (4) thus obtained was exposed to a xenon lamp (500 watt) having almost flat light intensity in the visible region through a line image original to provide light bleached images (positive images light-bleached at the exposed portions) of magenta color.

Then, after the formation of images, each of Samples (1) to (4) was passed through heating rollers kept at 120° C. (the temperature was confirmed to be about 20° C. higher than the glass transition temperature of the microcapsule wall, and was higher than the melting point of the fixing agent by the measurement of the dynamic viscoelasticity) at a speed of 450 mm/min. to promote the permeability of the microcapsule wall by heat, whereby fixing (the contact of the components existing in the inside of and outside the microcapsules) was performed. Then, the visible region reflective density at the exposed portions and unexposed portions of images thus obtained was measured by a Macbeth RD-918 type densitometer.

The results obtained are shown in Table 1.

TABLE 1

| Sample No. | Mol Ratio* | Exposure Time (second) | Reflective Density of Unexposed Portion | Reflective Density of Exposed Portion |
|---|---|---|---|---|
| (1) | 1:1 | 20 | 1.38 | 0.070 |
| (2) | 1:1.5 | 10 | 1.41 | 0.071 |
| (3) | 1:1 | 20 | 1.40 | 0.069 |
| (4) | 1:1.5 | 10 | 1.42 | 0.070 |

*Mol ratio of organic cationic dye compound/organic boron compound

Furthermore, when each of the samples thus fixed was subjected to overall light exposure with the same intensity as that of the image exposure using a xenon lamp for a period of 5 times, no change of the images was observed.

From the aforesaid results, it can be seen that the image forming materials of this invention has excellent image reproducibility and image storage stability (fixing property) and also the method of this invention is a simple recording method (all dry process using only two steps of image exposure and heat fixing). Also, it can be seen that the light bleached image forming speed is higher in Samples (2) and (4) using a slightly excessive amount of the organic boron compound anion than Samples (1) and (3), and there is almost no difference in performance between the case of encapsulating the light bleaching component as the form of the salt (Samples (1) and (2)) and the case of simply uniformly mixing the organic cationic compound and the organic boron compound in an oil (Samples (3) and (4)).

EXAMPLE 2

By following the same procedure as in the case of preparing Sample (4) in Example 1, except that each of the compounds shown in Table 2 below was used as the organic boron compound, Samples (5) to (8) were prepared.

TABLE 2

| Sample No. | Organic Boron Compound | Amount (part) |
|---|---|---|
| (5) | 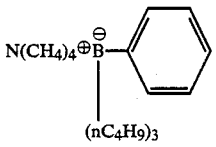 | 0.25 |
| (6) | 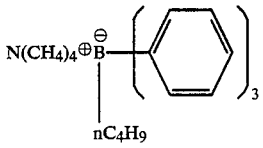 | 0.28 |

TABLE 2-continued

| Sample No. | Organic Boron Compound | Amount (part) |
|---|---|---|
| (7) | 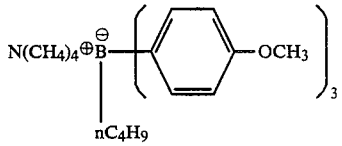 | 0.35 |
| (8) | $N(nC_4H_9)_4{}^{\oplus}\overset{\ominus}{B}(nC_4H_9)_4$ | 0.36 |

When each of Samples (5) to (8) was evaluated in the same manner as in Example 1 (Sample (4)), substantially the same results as for Sample (4) were obtained.

EXAMPLE 3

By following the same procedure as in the case of preparing Sample (4) in Example 1, except that each of the compounds shown in Table 3 was used as the organic cationic dye, Samples (9) to (14) were obtained.

TABLE 3

| Sample No. | Organic Cation Dye Compound | Amount (part) |
|---|---|---|
| (9) | 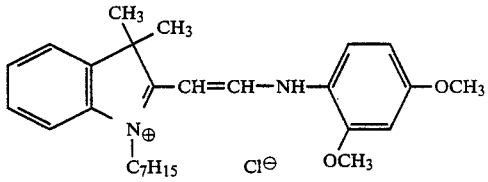 | (Dye No 13: Yellow Dye) 0.19 part |
| (10) | 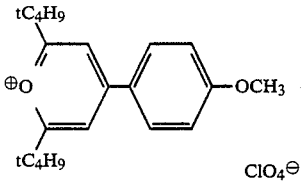 | (Dye No 16: Yellow Dye) 0.20 part |
| (11) | 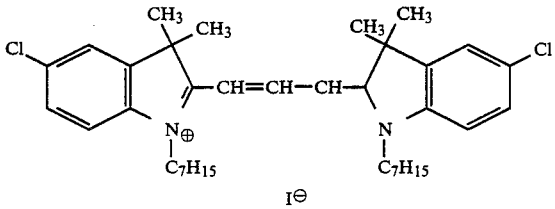 | (Dye No 7: Magenta Dye) 0.36 part |
| (12) | 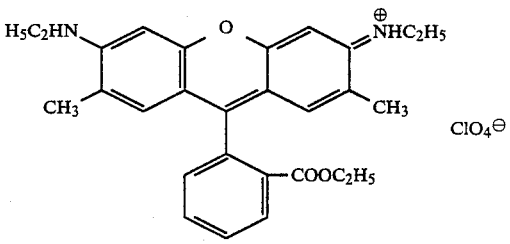 | (Dye No 10: Magenta Dye) 0.27 part |

TABLE 3-continued

| Sample No. | Organic Cation Dye Compound | Amount (part) |
|---|---|---|
| (13) | 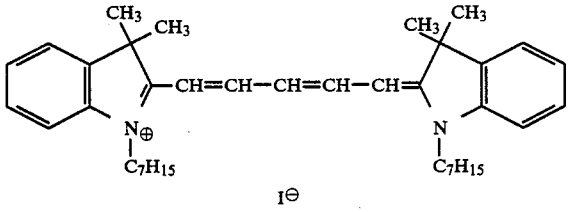 | (Dye No 9: Cyan Dye) 0.34 part |
| (14) | 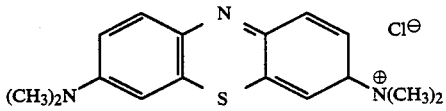 | (Dye No 3: Cyan Dye) 0.16 part |

Each of Samples (9) to (14) was evaluated by the same manner as in Example 1 and the results obtained are shown in Table 4.

TABLE 4

| Sample No. | Reflective Density at Unexposed Portion | Reflective Density at Exposed Portion |
|---|---|---|
| (9) | 1.22 | 0.071 |
| (10) | 1.24 | 0.069 |
| (11) | 1.38 | 0.069 |
| (12) | 1.39 | 0.070 |
| (13) | 1.41 | 0.072 |
| (14) | 1.33 | 0.070 |

From the results shown above, it can be seen that in the image forming method of this invention, invention, clear images corresponding to the hue specific to each organic cationic dye compound can be obtained and also a sure image storage stability (fixing property) can be realized for each color by a simple dry heat treatment.

EXAMPLE 5

By following the same procedure as the case of preparing Sample (4) in Example 1, except that each of the compounds shown in Table 5 was used as the fixing agent existing outside the microcapsules, Samples (15) to (18) were prepared.

TABLE 5

| Sample No. | Fixing Agent |
|---|---|
| (15) | 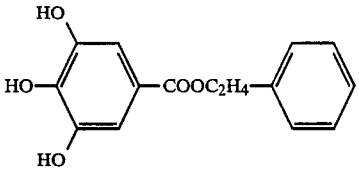 (Fixing Agent No. 3) |
| (16) | 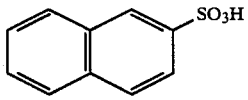 (Fixing Agent No. 13) |

TABLE 5-continued

| Sample No. | Fixing Agent |
|---|---|
| (17) | 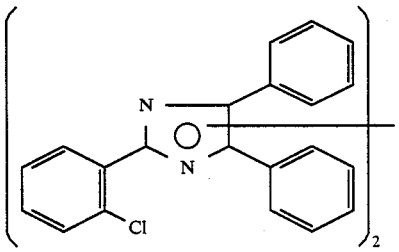 (Fixing Agent No. 18) |
| (18) | 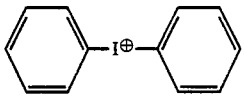 (Fixing Agent No. 20) $PF_6^{\ominus}$ |

When each of Samples (15) to (18) was evaluated by the same manner as in Example 1 (Sample (4)), almost the same image forming property and fixing property were obtained.

EXAMPLE 6

The emulsified dispersion of a fixing agent was prepared as follows.

That is, 42 parts of the fixing agent show by

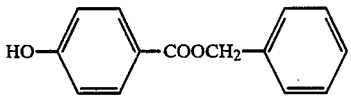

as used in Example 1 was dissolved in a mixture of 8 parts of 1-phenyl-1-xylylethane and 30 parts of ethyl acetate.

The solution of the fixing agent was dispersed by emulsification in a mixture of 100 parts of an aqueous solution of 8% by weight polyvinyl alcohol, 150 parts of distilled water, and 0.5 part of sodium dodecylbenzenesulfonate to provide an emulsified dispersion having oil droplet size of 0.5 μm.

Then, 18 parts of the emulsified dispersion of the fixing agent was mixed with 9 parts of the microcapsule dispersion as used for preparing Sample (4) and 9 parts of distilled water, and then, by following the same procedure as the case of preparing Sample (4), Sample (19) was prepared.

When Sample (19) was evaluated by the same manner as Sample (4), substantially the same results were obtained. Thus, it can be seen that when the fixing agent existing outside the microcapsules was used in the state of emulsified dispersion, the same performance as in the case of using it as a solid dispersion can be obtained.

EXAMPLE 7

Image forming materials (samples) were prepared as follows.

Sample (20)

The following components were uniformly mixed.

| | |
|---|---|
| 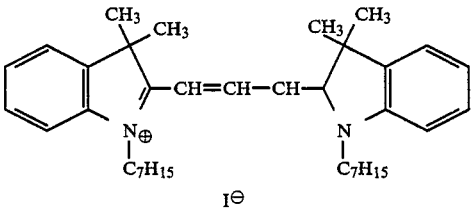 | 0.61 part |
| (Dye No. 6)* | |
| $N(CH_3)_4^{\oplus}\ B^{\ominus}(nC_4H_9)_4$* | 0.44 part |
| Methyl isobutyl ketone | 20 parts |
| Diisopropylnaphthalene | 30 parts |
| SUMIDUR N-75 (made by Sumitomo Chemical Company, Ltd.) | 3.3 parts |

*Mol ratio of organic cationic dye compound/organic boron compound

The mixture was dispersed by emulsification in an aqueous solution (pH adjusted to 6.0) composed of 154 parts of distilled water, 4.3 parts of sodium polystyrenesulfonate (VERSA TL-502, made by National Starch Co.), and 5.1 parts of pectin.

A melamine/formalin prepolymer solution obtained by heating a mixture of 44 parts of distilled water, 3.9 parts of melamine, and 6.5 parts of 37% formaldehyde solution (formalin) to 60° C. for 30 minutes was added to the emulsified dispersions described above and the pH thereof was adjusted to 6.0. Then, the temperature of the mixture was raised to 65° C., and the mixture was stirred for 3 hours to perform reaction. To the reaction mixture was added 7.7 parts of urea to treat remaining formalin and then the pH thereof was adjusted to 9.5 with an aqueous solution of sodium hydroxide to provide a dispersion of melamine/formalin resin microcapsules having particle size of 3.5 μm.

By following the same procedure as Sample (4) in Example 1 using the microcapsule dispersion, Sample (20) was prepared.

Sample (21)

By following the same procedure as in the case of preparing Sample (4) in Example 1, except that the particle size of the microcapsules was controlled to 3.5 μm, Sample (21) was prepared.

When each of Samples (20) and (21) was imagewise exposed by a xenon lamp as in Example 1, clear images were obtained. Then, each of the samples was passed through press rollers at a line pressure of 100 kg/cm. Thereafter, each sample was subjected to overall exposure with the same intensity that of the image exposure using a xenon lamp for a period of 5 times, but no change of the images was observed.

Thus, it can be seen that in the image forming method of this invention, an excellent fixing property can be realized by the collapse of microcapsules by pressing and the contact of the components (i.e., the light bleaching component and the fixing agent) existing in the inside of and outside the microcapsules following the collapse.

EXAMPLE 8

Sample (22)

The sample was prepared as follows.

The following components were mixed.

| | |
|---|---|
| Microcapsule dispersion (yellow) as used for Sample (10) | 9 parts |
| Microcapsule dispersion (magenta) as used for Sample (4) | 8 parts |
| Microcapsule dispersion (cyan) as used for Sample (13) | 8 parts |
| Fixing agent dispersion as used for Sample (1) | 20 parts |

The mixture was coated on an art paper using coating rod 30 and dried for 1 minute at 50° C. to provide Sample (22).

When the sample was exposed to a xenon lamp through a full color positive original, full color light bleached images substantially same as the original were obtained.

The color images were completely fixed by a subsequent heat fixing treatment, and no change of images was observed, even in bright room.

From the aforesaid results, it can be seen that the image forming material has excellent image reproducing properties and image storage stability (fixing property), and very easily forms multicolor images. The image forming method and the fixing method are also completely dry and simple. Furthermore, problems of cost and safety, such as handling in an organic solvent system which is disadvantageous for production aptitude, and the use of a multilayer coating equipment for obtaining multicolor images are reduced or completely eliminated.

While the invention has been described in detail and with reference to specific embodiments thereof, it will be apparent to one skilled in the art that various changes and modifications can be made therein without departing from the spirit and scope thereof.

What is claimed is:

1. An image forming material comprising a support having thereon a microcapsule-containing layer, said layer consisting essentially of at least one organic boron compound anion salt of an organic cationic dye compound represented by formula (I):

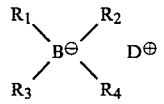

(I)

wherein $D^{\oplus}$ represents a cationic dye and $R_1$, $R_2$, $R_3$, and $R_4$ each represents a group selected from an alkyl group, an aryl group, an aralkyl group, an alkaryl group, an alkenyl group, an alkynyl group, an alicyclic group, a heterocyclic group, an allyl group, and derivatives of these groups; or two or more of said $R_1$, $R_2$, $R_3$ and $R_4$ combine together to form a cyclic structure;

at least one compound capable of cleaving at least one carbon-boron bond; and a polymer to encapsulate a core material containing said organic boron compound anion salt of an organic cationic dye compounds, said organic boron compound anion salt being isolated from said compound capable of cleaving at least one carbon-boron bond by the walls of microcapsules, and said walls of the microcapsules being capable of increasing permeability thereof upon an increase in temperature.

2. An image forming material as claimed in claim 1, wherein the size of the microcapsules is from 0.1 μm to 20 μm.

3. An image forming material as claimed in claim 1, wherein the size of the microcapsules is from 0.1 μm to 4 μm.

4. An image forming material as claimed in claim 1, wherein the molar ratio of the organic boron compound anion with respect to the organic cationic dye is from 1/1 to ½.

5. An image forming method which comprises imagewise exposing an image forming material to form an image, wherein said image forming material comprises a support having thereon a microcapsule-containing layer, said layer consisting essentially of at least one organic boron compound anion salt of an organic cationic dye compound represented by formula (I):

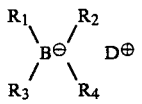

(I)

wherein $D^{\oplus}$ represents a cationic dye and $R_1$, $R_2$, $R_3$, and $R_4$ each represents a group selected from an alkyl group, an aryl group, an aralkyl group, an alkaryl group, an alkenyl group, an alkynyl group, an alicyclic group, a heterocyclic group, an allyl group, and derivatives of these groups; or two or more of said $R_1$, $R_2$, $R_3$ and $R_4$ combine together to form a cyclic structure;

at least one compound capable of cleaving at least one carbon-boron bond; and a polymer to encapsulate a core material containing said organic boron compound anion salt of an organic cationic dye compound, said organic boron compound anion salt being isolated from said compound capable of cleaving at least one carbon-boron bond by the walls of microcapsules, and said walls of the microcapsules being capable of increasing permeability thereof upon and increase in temperature;

then heating said image forming material at a high enough temperature to allow said organic boron compound which is encapsulated in said microcapsule to escape from said microcapsule, or introduce into the microcapsule said compound capable of cleaving at least one carbon-boron bond through said walls of the microcapsules to bring said components isolated by said walls of the microcapsules into contact with each other to fix said image formed.

6. An image forming method as claimed in claim 5, wherein said compound capable of cleaving at least one carbon-boron bond is used in an amount of from 1 to 100 molar times the amount of the organic boron compound anion.

7. An image forming method as in claim 5, wherein said compound capable of cleaving at least one carbon-boron bond is used in an amount of from 1 to 10 molar times the amount of the organic boron compound anion.

* * * * *